US005184564A

United States Patent [19]

Robbins et al.

[11] Patent Number: 5,184,564

[45] Date of Patent: Feb. 9, 1993

[54] BOAT FOR PERSONAL WATERCRAFT

[75] Inventors: Warren H. Robbins, Fountain Valley; Lawrence C. Smith, Montecito, both of Calif.

[73] Assignee: Team Scarab, Inc., Ventura, Calif.

[21] Appl. No.: 857,646

[22] Filed: Mar. 25, 1992

[51] Int. Cl.[5] ..... B63D 35/00

[52] U.S. Cl. ..... 114/270; 114/352; 114/345; 440/38

[58] Field of Search ..... 114/68, 123, 270, 283, 114/352, 345, 248, 343, 364; 440/38

[56] References Cited

U.S. PATENT DOCUMENTS

| | | | |
|---|---|---|---|
| 4,625,669 | 12/1986 | Nishida | 114/270 |
| 4,694,770 | 9/1987 | Kitner et al. | 114/248 |
| 4,811,682 | 3/1989 | Hwang et al. | 114/345 |
| 4,909,176 | 3/1990 | Kobayashi | 114/123 |
| 4,928,619 | 3/1990 | Cochran | 114/345 |

OTHER PUBLICATIONS

Yamaha Marine Division, 4 page brochure, LIT.181191087.

6 Page brochure of Pro Jet by Zodiac.

Team Scarab, ,Inc., 4 page brochure, 1 page specification & drawing.

Yukon Inflatables, single page, double side brochure.

Castoldi, Jet Tender 4.90, 4 page brochure.

HBI, 16 page brochure, HBI 3-89-10M.

The Party Shark by Cobra Boats, single page brochure.

*Primary Examiner*—Edwin L. Swinehart

*Attorney, Agent, or Firm*—Harris, Kern, Wallen & Tinsley

[57] ABSTRACT

A boat for use with a personal watercraft type vehicle, with the vehicle having a hull with bow, side walls and stern, and with the inflatable boat having a U-shaped tube or pontoon for flotation, with a closed forward end and an open rear end, a connection system for engaging the vehicle for insertion of the vehicle into the pontoon and removal of the vehicle from the pontoon, and a transom for closing the open rear end of the pontoon. Preferably the vehicle slides into and out of the pontoon.

15 Claims, 4 Drawing Sheets

FIG. 1
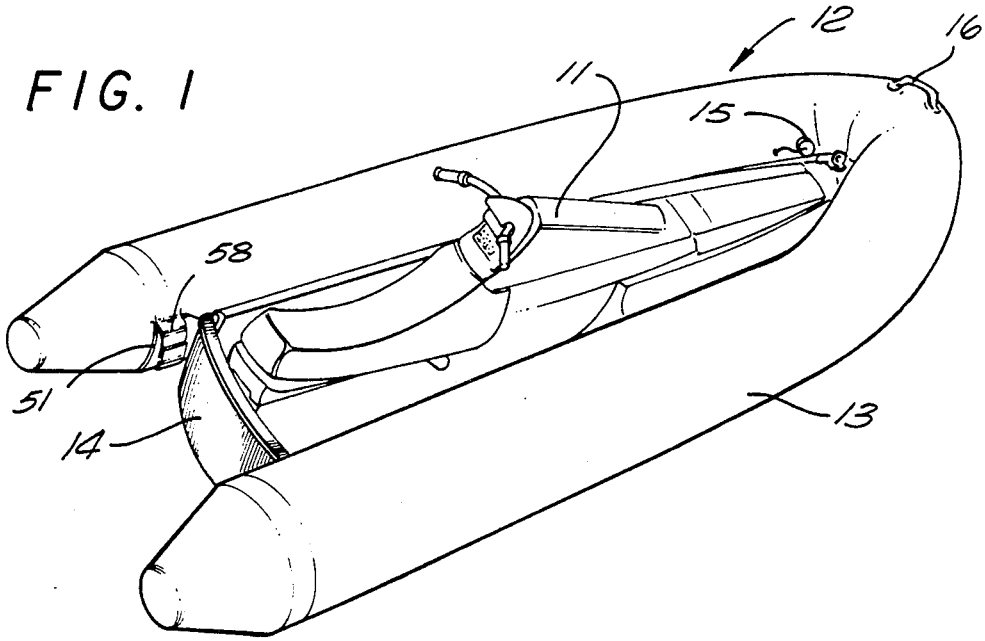
FIG. 4
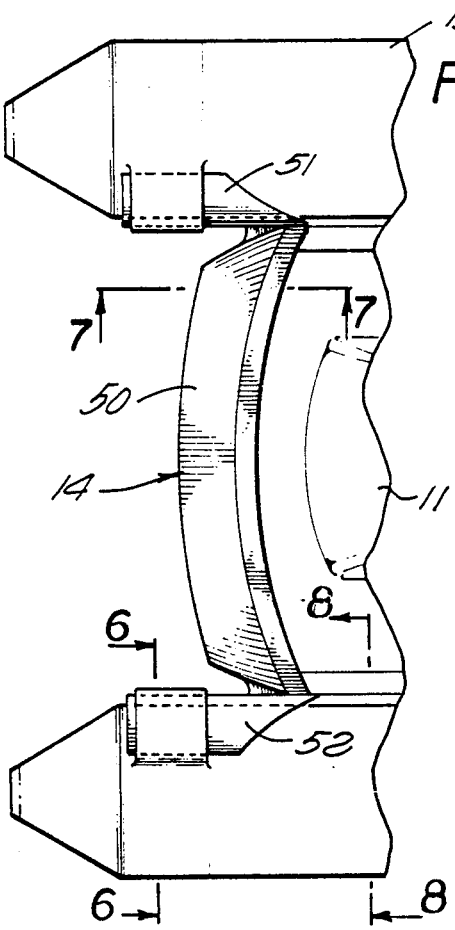
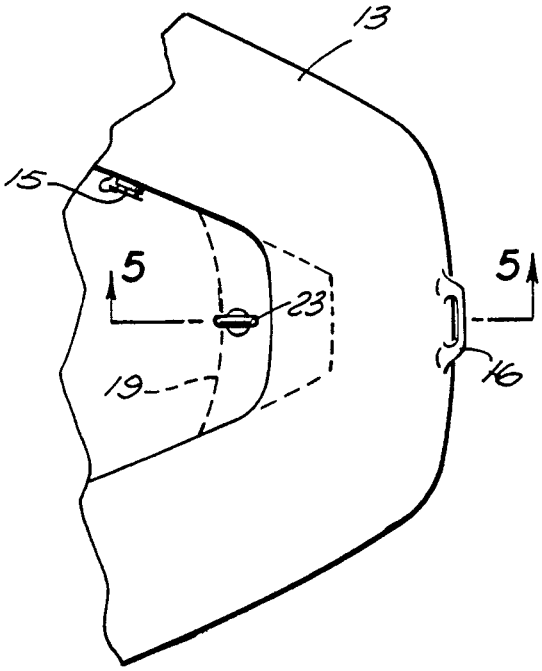
FIG. 3

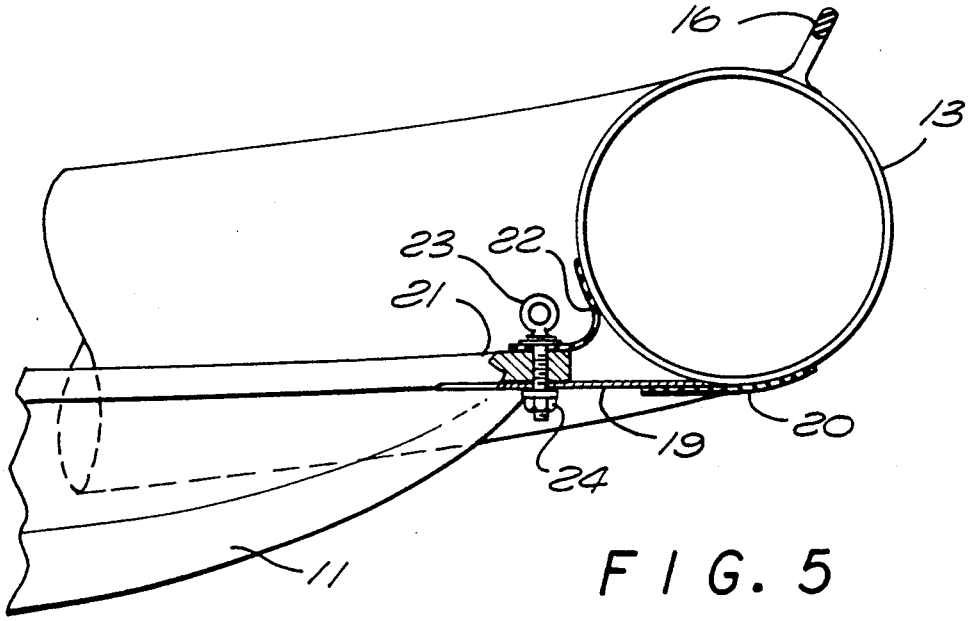
FIG. 5
FIG. 6A
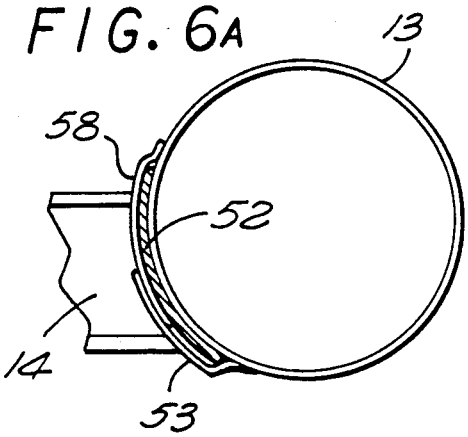
FIG. 6B
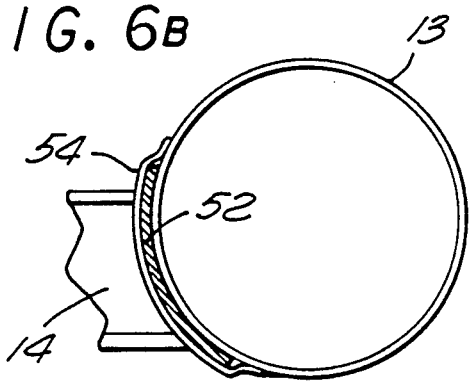
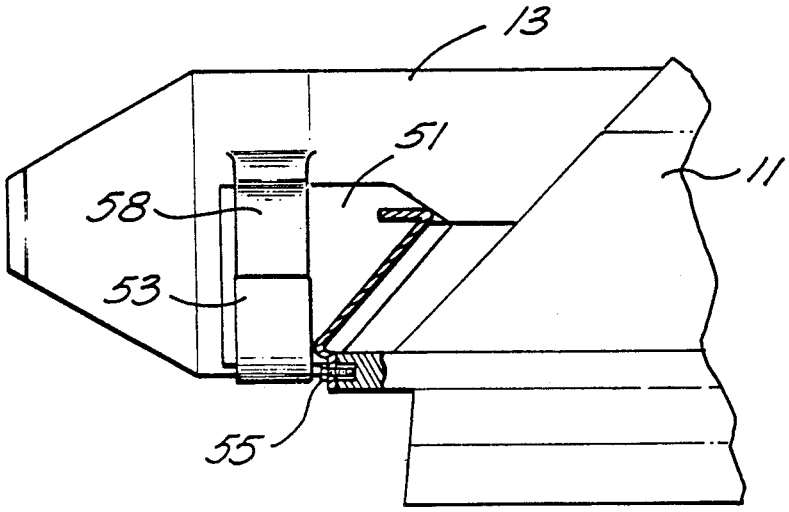
FIG. 7

BOAT FOR PERSONAL WATERCRAFT

BACKGROUND OF THE INVENTION

This invention relates to boats of the type now generally known as personal watercraft. Such a vehicle typically has a hull with an internal combustion engine and a jet pump drive, with the operator standing or sitting on or in the vehicle. Products of this type are presently being sold under the brand names Jet Ski and Wave Runner.

In the conventional personal watercraft vehicle, the operator stands in the hull or sits on a motorcycle type seat projecting upward from the hull. With this configuration, the operator and when a motorcycle type seat is utilized, the passenger, are subjected to a considerable water splashing, particularly when high speed maneuvers are executed.

Sometimes it is desired to have a calmer type ride more akin to cruising with the operator and passenger or passengers less subject to the discomforts accompanying the conventional personal watercraft use.

There are many types of boats available which provide this type of operation where the people sit within the vehicle rather than stand or ride upon the vehicle. These are often known as rigid inflatable boats or RIBs. A rigid inflatable boat has a fixed bottom and transom attached to an inflatable hull.

It is an object of the present invention to provide a new and improved boat which can be utilized with a conventional personal watercraft, with the watercraft vehicle readily attachable to the boat and removable from the boat, so that the operator can have either mode of operation with a simple insertion or removal of the watercraft vehicle from the boat.

Further objects of the invention are to provide such a boat which is simple, inexpensive, easily stored, and readily attachable and detachable. An additional object is to provide such a boat which may be inflated and deflated so as to reduce storage and transportation problems.

Other objects, advantages, features and results will more fully appear in the course of the following description.

SUMMARY OF THE INVENTION

A boat for use with a personal watercraft type vehicle, with the vehicle having a hull with bow, side walls and stern, and with the inflatable boat including U-shaped inflatable tube or pontoon means for flotation with a closed forward end and an open rear end, connection means for engaging the vehicle for insertion of the vehicle into the pontoon means and removal of the vehicle from the pontoon means, and a transom for closing open rear end of the pontoon means.

In the preferred embodiment, the vehicle slides into and out of the pontoon means, and the pontoon means and transom have interengaging means for removably attaching the transom to the pontoon means. Further in the preferred embodiment, the connection means includes a longitudinal rib along each inner side of the pontoon means, and a mating longitudinal member on each side of the vehicle.

BRIEF DESCRIPTION OF THE DRAWINGS

FIG. 1 is a perspective view illustrating a personal watercraft connected with a boat incorporating the presently preferred embodiment of the invention;

FIG. 3 is an enlarged top view of the forward portion of the craft of FIG. 1;

FIG. 4 is an enlarged top view of the rear portion of the craft of FIG. 1;

FIG. 5 is an enlarged sectional view taken along the line 5—5 of FIG. 3;

FIG. 6A is an enlarged sectional view taken along the line 6—6 of FIG. 4;

FIG. 6B is a view similar to that of FIG. 6A showing an alternative construction;

FIG. 7 is an enlarged sectional view taken along the line 7—7 of FIG. 4;

DESCRIPTION OF THE PREFERRED EMBODIMENTS

Figure 2:
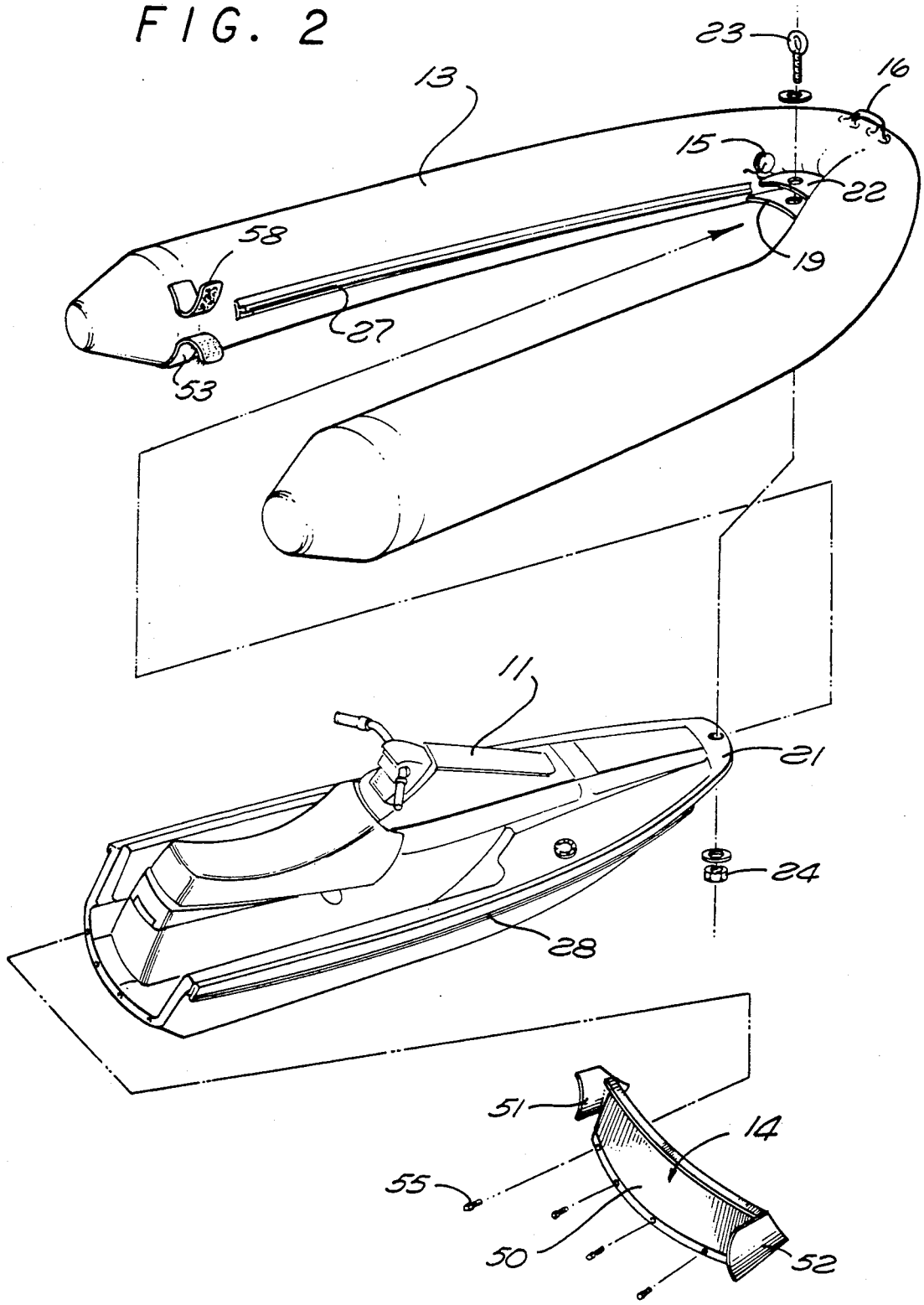
FIG. 2 is an exploded view of FIG. 1 illustrating the attachment and detachment of the components.

In FIG. 1, a personal watercraft vehicle 11 is engaged with the boat 12 of the invention, and in FIG. 2, the two items are shown separated. The boat 12 includes a U-shaped inflatable tube or pontoon 13 and a transom 14 joining the open ends of the U-shaped pontoon.

The boat is designed to receive and retain the vehicle, including connection means for engaging the vehicle for insertion of the vehicle into the pontoon and removal of the vehicle from the pontoon. In the embodiment illustrated, the watercraft vehicle slides into the pontoon from the rear through the open end of the U-shape, and typically this open end is then closed by the transom 14.

One or more inflation fittings 15 may be provided on the pontoon, as desired. Typically a handle 16 is provided at the forward end of the pontoon for ease of handling.

Means are provided for attaching the vehicle to the boat. In the embodiment illustrated this means includes a nose plate 19 fixed to the pontoon 13 by a flap 20, with the nose plate generally horizontal and shaped to receive the forward end of the bow 21 of the vehicle, as best seen in FIG. 5. An upper gasket 22 may also be carried on the pontoon for positioning over the bow of the vehicle for protection. The components are joined together by an eye bolt 23 and nut 24, with the bolt passing through openings in the flap 22, bow 21 and plate 19.

The connection means also includes a longitudinal rib 27 along each inner side of the pontoon 13, and a mating longitudinal member 28 on each side of the vehicle 11. One such construction is shown in greater detail in FIG. 8A. The longitudinal rib 27 has a lower flange 29 and an upper flange 30 attached to the pontoon 13, and a projecting section 31 with a larger outer portion 32 and a smaller neck portion 33. The longitudinal member 28 carried on the vehicle 11 has a mating opening and slot for slidingly receiving the projecting section 31 of the longitudinal rib 27.

The vehicle 11 has a deck member 36 and a side member 37 with overlapping flanges, and a protective strip 38 all joined by bolts and nuts through aligned openings. The longitudinal member 28 is attached to the vehicle by removing the nuts, positioning the member 28 against the flanges over the bolts 39, and reattaching the nuts. The access opening in the protective strip 38 is covered by a removable strip 40. The longitudinal ribs 27 and longitudinal members 28 preferably are aluminum or plastic extrusions.

Figure 8A:
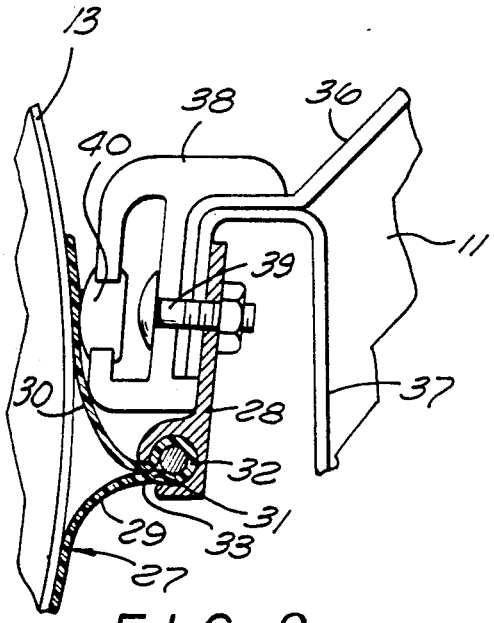
FIG. 8A is an enlarged sectional view taken along the line 8—8 of FIG. 4.
Figure 8B:
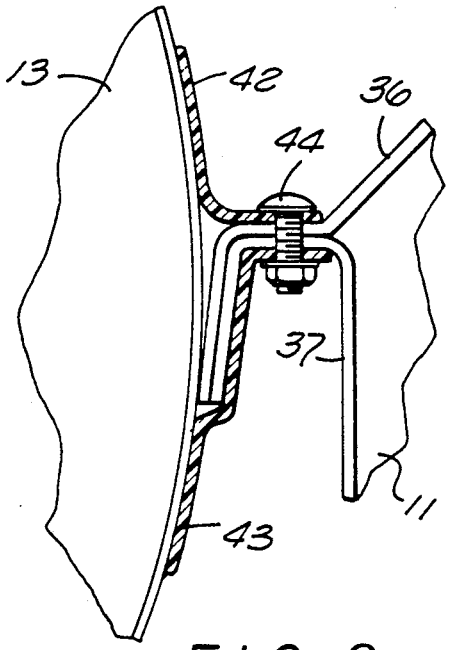
FIGS. 8B and 8C are views similar to that of FIG. 8A illustrating alternative embodiments.

An alternative construction is shown in FIG. 8B with the longitudinal ribs 27 comprising spaced upper and lower flanges 42,43 attached to the pontoon, with the flanges 36,37 of the vehicle sliding between the spaced flanges 42,43 and attached by bolts 44 and nuts through aligned openings in the longitudinal ribs and longitudinal members. In this embodiment, the flanges 36,37 serve as the mating longitudinal members 28.

Figure 8C:
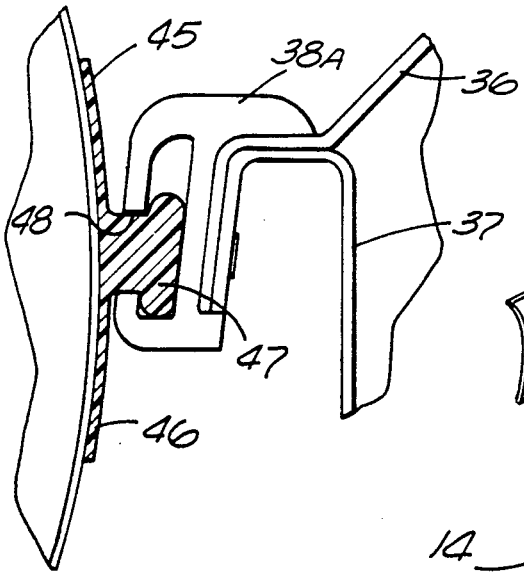

Another alternative configuration is shown in FIG. 8C where the longitudinal ribs have upper and lower flanges 45,46 with a projecting section 47 having a larger outer portion and a smaller neck portion. A protective strip 38A similar to the protective strip 38 of FIG. 8A is provided with a longitudinal slot 48 for slidingly receiving the narrower portion of the projecting section 47. In this embodiment, the strip 38A serves as the mating longitudinal member 28. Various other constructions for the connection of the vehicle to the boat may be utilized if desired.

The transom 14 is attached between the open ends of the pontoon 13 after the vehicle 11 is inserted. The pontoon and the transom 14 have interengaging means for removably attaching the transom to the pontoon. One such arrangement is shown in FIGS. 4, 6A and 7. The transom has a lateral member 50 and side plates 51,52. The side plates 51,52 should be shaped to conform to the contour of the pontoon 13. Overlapping flaps 52,53 are attached to the pontoon with a suitable arrangement for joining the flaps together, such as the conventional hook and eye arrangement, sometimes sold as Velcro. The transom is placed in position as shown in FIGS. 4 and 6A, the upper flap 52 is folded down over the side plate 51, and the lower flap 53 is placed in position over the flap 52, with the flaps being removably adhered to each other. In an alternative arrangement as shown in FIG. 6B, pockets 54 are attached to the pontoon 13 for slidingly receiving the side plates 51. If desired, the transom may be attached to the stern of the vehicle, as by screws 55 threaded directly into the stern of the vehicle or into threaded inserts in the stern of the vehicle.

Figure 9:
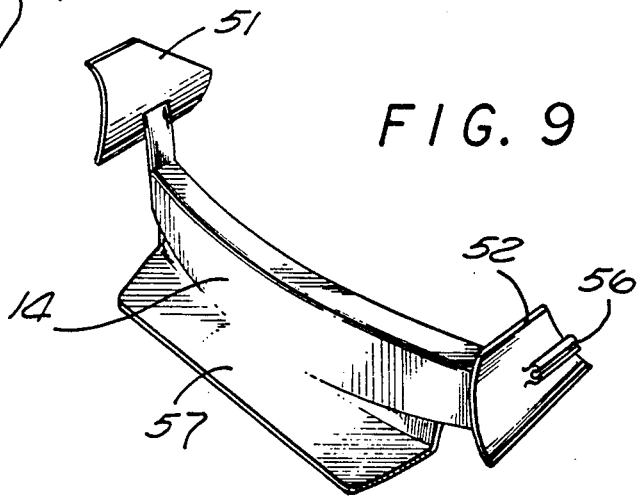
FIG. 9 is an enlarged view of the transom of FIG. 2, showing an alternative embodiment.

An alternative configuration for the transom 14 is shown in FIG. 9. Short lengths of longitudinal members 56 may be attached to the side plates 51,52. These longitudinal members 56 correspond with the longitudinal members 28 of the vehicle for sliding engagement with the longitudinal ribs 27 of the pontoon. Also, a platform or step 57 may be provided extending aft from the transfom if desired. The transom may be high as shown in FIGS. 1 and 2, or may be lower or open as shown in FIG. 9 to allow access from the rear.

With the conversion capability of the boat of this invention a single personal watercraft is quickly changed from a racy high maneuverable 1 or 2 passenger craft to a more stable, buoyant and safer boat for 4–6 people suitable for use as a tender, as a dive, fish or hunt boat, a 3 passenger boat for waterskiing with observer, and patrol and guard duty, and just as easily changed back to a personal watercraft.

We claim:

1. A boat for use with a small-sized, independently powered and driveable watercraft vehicle, said vehicle having a self-sustaining flotation hull with bow, side walls and stern, for conversion between a first useable state comprising said vehicles and a second useable state comprising said vehicle and boat combined, said boat including in combination:

U-shaped inflatable pontoon means for flotation, with a closed forward end and spaced sides defining an open central section, with said spaced sides having rear ends;

connection means for engaging said independently powered vehicle for inserting of said independently powered vehicle into said pontoon means and removal of said independently powered vehicle from said pontoon means; and a transom for interconnecting said rear ends of said pontoon means.

2. A boat as defined in claim 1 with said pontoon means and transom having interengaging means for removably attaching said transom to said pontoon means.

3. A boat as defined in claim 2 including means for attaching said transom to said stern of said vehicle.

4. A boat as defined in claim 1 including a generally horizontal nose plate fixed to said pontoon means at said forward end, with an opening for attaching said bow of said vehicle to said pontoon means.

5. A boat as defined in claim 1 wherein said connection means includes a longitudinal rib along each inner side of said pontoon means, and a mating longitudinal member on each side of said vehicle for sliding insertion of said vehicle into said pontoon means.

6. A boat as defined in claim 5 with said transom having transom longitudinal ribs along each side corresponding to and aligned with said vehicle longitudinal members.

7. A boat for use with a small-sized, watercraft vehicle, said vehicle having a hull with bow, side walls and stern, said boat including in combination:

U-shaped inflatable pontoon means for flotation, with a closed forward end and spaced sides defining an open central section, with said spaced sides having rear ends;

connection means for engaging said vehicle for insertion of said vehicle into said pontoon means and removal of said vehicle from said pontoon means; and a transom for interconnecting said rear ends of said pontoon means;

said pontoon means and transom having interengaging means for removably attaching said transom to said pontoon means, said means for removably attaching said transom to said pontoon means including said plates at each side of said transom contoured to mate with said pontoon means, and overlapping flaps carried on said pontoon means for positioning over said transom side plates, with said flaps including means for fastening said flaps together over a side plate.

8. A boat for use with a small-sized, watercraft vehicle, said vehicle having a hull with bow, side walls and stern, said boat including in combination:

U-shaped inflatable pontoon means for flotation, with a closed forward end and spaced sides defining an open central section, with said spaced sides having rear ends;

connection means for engaging said vehicle for insertion of said vehicle into said pontoon means and removal of said vehicle from said pontoon means; and a transom for interconnecting said rear ends of said pontoon means;

said pontoon means and transom having interengaging means for removably attaching said transom to said pontoon means, said means for removably attaching said transom to said pontoon means including side plates at each side of said transom contoured to mate with said pontoon means, and pockets carried on said pontoon means for slidingly receiving said transom side plates.

9. A boat for use with a small-sized, watercraft vehicle, said vehicle having a hull with bow, side walls and stern, said boat including in combination:

U-shaped inflatable pontoon means for flotation, with a closed forward end and spaced sides defining an open central section, with said spaced sides having rear ends;

connection means for engaging said vehicle for insertion of said vehicle into said pontoon means and removal of said vehicle from said pontoon means; and a transom for interconnecting said rear ends of said pontoon means;

said connection means including a longitudinal rib along each inner side of said pontoon means, and a mating longitudinal member on each side of said vehicle for sliding insertion of said vehicle into said pontoon and, each of said longitudinal ribs having a flange attached to said pontoon member and a projecting section with a larger outer portion joined to said flange by a smaller neck portion, and each of said mating longitudinal members having means defining an opening and a slot, with said rib outer portion sliding in said opening and said rib neck portion sliding in said slot.

10. A boat for use with a small-sized, watercraft vehicle, said vehicle having a hull with bow, side walls and stern, said boat including in combination:

U-shaped inflatable pontoon means for flotation, with a closed forward end and spaced sides defining an open central section, with said spaced sides having rear ends;

connection means for engaging said vehicle for insertion of said vehicle into said pontoon means and removal of said vehicle from said pontoon means; and a transom for interconnecting aid rear ends of said pontoon means;

said connection means including a longitudinal rib along each inner side of said pontoon means, and a mating longitudinal member on each side of said vehicle for sliding insertion of said vehicle into said pontoon means, each of said longitudinal ribs including parallel longitudinal flanges with attachment openings therealong, with said flanges spaced to receive said vehicle longitudinal member therebetween.

11. A boat for use with a small-sized watercraft vehicle, said vehicle having a hull with bow, side walls and stern, said boat including in combination:

U-shaped inflatable pontoon means for flotation with a closed forward end and an open rear end;

connection means for engaging said vehicle for insertion of said vehicle into said pontoon means and removal of said vehicle from said pontoon means;

with said connection means including a longitudinal rib along each inner side of said pontoon means, and a mating longitudinal member on each side of said vehicle;

a transom for interconnecting said rear end of said pontoon means, with said pontoon means and transom having interengaging means for removably attaching said transom to said pontoon means;

with said means for removably attaching said transom to said pontoon means including side plates at each side of said transom contoured to mate with said pontoon means; and a generally horizontal nose plate fixed to said pontoon means at said forward end, with an opening for attaching said bow of said vehicle to said pontoon means.

12. A boat as defined in claim 11 wherein each of said longitudinal ribs has a flange attached to said pontoon member and a projecting section with a larger outer portion joined to said flange by a smaller neck portion, and each of said mating longitudinal members has means defining an opening and a slot, with said rib outer portion sliding in said opening and said rib neck portion sliding in said slot.

13. A boat as defined in claim 11 wherein each of said longitudinal ribs includes parallel longitudinal flanges with attachment openings therealong, with said flanges spaced to receive said vehicle longitudinal member therebetween.

14. A boat as defined in claim 11 with said transom having transom longitudinal ribs along each side corresponding to and aligned with said vehicle longitudinal members.

15. A boat for use with a small-sized, independently powered and driveable watercraft vehicle, said vehicle having a self-sustaining flotation hull with bow, side walls and stern, for conversion between a first useable state comprising said vehicle and a second useable state comprising said vehicle and boat combined, said boat including in combination:

U-shaped inflatable pontoon means for flotation with a closed forward end and spaced sides defining an open central section, with said spaced sides having rear ends;

connection means for engaging said vehicle for sliding insertion of said vehicle into said pontoon means and removal of said vehicle from said pontoon means while said pontoon means is inflated;

said connection means including a longitudinal rib along each inner side of said pontoon means, and a mating longitudinal member on each side of said vehicle for sliding insertion of said vehicle into said pontoon means; and a transom for interconnecting said rear ends of said pontoon ıeans, with said pontoon means and transom having interengaging means for removably attaching said transom to said pontoon means.

* * * * *